United States Patent [19]

Carli

[11] 4,070,555

[45] Jan. 24, 1978

[54] SWITCHING MECHANISM

[75] Inventor: Alvin J. Carli, Sebring, Ohio

[73] Assignee: The Alliance Manufacturing Company, Alliance, Ohio

[21] Appl. No.: 636,080

[22] Filed: Nov. 28, 1975

[51] Int. Cl.[2] ..... H01H 21/80; H01H 1/50; H01H 9/02

[52] U.S. Cl. ..... 200/6 B; 200/6 BB; 200/153 G; 200/153 H; 200/153 L; 200/153 LB; 200/164 R; 200/241; 200/303; 200/318; 200/339

[58] Field of Search ..... 200/6 R, 6 B, 6 BB, 200/6 C, 17 R, 153 G, 153 H, 153 L, 153 LB, 303, 318, 339, 340, 159 B, 164 R, 241, 294; 74/483 PB

[56] References Cited

U.S. PATENT DOCUMENTS

| | | | |
|---|---|---|---|
| 3,829,646 | 8/1974 | Lorteije et al. | 200/340 X |
| 3,860,771 | 1/1975 | Lynn et al. | 200/159 B X |
| 3,878,344 | 4/1975 | Lockard | 200/6 B |
| 3,952,175 | 4/1976 | Golbeck et al. | 74/483 PB |

FOREIGN PATENT DOCUMENTS

| | | | |
|---|---|---|---|
| 1,216,717 | 11/1959 | France | 200/159 B |
| 2,459,464 | 6/1975 | Germany | 200/159 B |
| 1,168,441 | 10/1969 | United Kingdom | 200/159 B |
| 1,259,356 | 1/1972 | United Kingdom | 200/339 |

*Primary Examiner*—Volodymyr Y. Mayewsky
*Attorney, Agent, or Firm*—Woodling, Krost, Granger & Rust

[57] ABSTRACT

A switching mechanism is disclosed which may be either a single pole or a multiple pole switch. Actuator means is provided to actuate first and second contact means between open and closed circuit conditions. This actuator means is shown as a lever which acts on an actuable portion of a contact blade or directly moves a contact portion into and out of engagement with an individual contact. For economy the actuator means lever may be unitary with a housing by means of a unitary hinge which not only permits movement of the lever but also provides a resilient force in first and second generally perpendicular directions. This resilient force is used to establish the contacts in a closed circuit condition and is also resisted by a detent so that the switch remains in that selected circuit condition. When the switching mechanism is constructed as a multiple pole switch, then a common conductor is provided which has individual contact portions actuated by a plurality of levers for an economically produced switch. The foregoing abstract is merely a resume of one general application, is not a complete discussion of all principles of operation or application, and is not to be construed as a limitation on the scope of the claimed subject matter.

41 Claims, 7 Drawing Figures

SWITCHING MECHANISM

Background of the Invention

The prior art has known many switches which have been constructed for a potential life of millions or even tens of millions of cycles of operation. In order to build that degree of reliability into a switch mechanism it is necessary to provide ruggedly constructed and carefully assembled parts. These many parts and the rugged construction of the parts and careful assembly have all added to the cost of such switch mechanisms.

The prior art has known many switch mechanisms and many are of the snap switch or toggle switch type in order to provide a rapid make and break to the contacts to minimize arcing at such contacts under a higher voltage or amperage conditions. Again such mechanisms to provide rapid action increase the complexity and cost of such switch mechanisms.

The prior art also has discovered that it is not particularly more expensive to change a switch construction from a single throw into a double throw switch usually because only an extra small contact need be added. Yet when one changes from a single pole to a double pole construction, the cost is nearly doubled because the physical size and complexity of parts is approximately doubled. Similarly, if a five pole or a ten pole switch mechanism is constructed, the prior art has found that the cost increases approximately five or ten times, respectively.

Accordingly, the prior art has many examples of switch mechanisms which are complex and costly to manufacture and assemble yet very few examples of switch mechanisms which are used in low current, low voltage applications and ones which require few cycles of operation during the intended lifetime.

Accordingly, an object of the invention is to provide an economical multiple pole switch.

Another object of the invention is to provide a switching mechanism of relatively few parts and with the number of those parts increasing in only a small amount with construction of additional poles on the switch mechanism.

Another object of the invention is to provide a switch mechanism with a minimum of parts to thus be economical in the cost of the parts and the cost of the assembly of the parts into the complete switch.

Another object of the invention is to provide a switch mechanism with a positive actuation of the contacts provided in a simple and efficient manner.

SUMMARY OF THE INVENTION

The invention may be incorporated in a switch mechanism comprising in combination, a base, a convex abutment carried relative to said base, a lever having an operating end, means fastening said lever relative to said base about an effective pivot point for cooperation of said operating end with said convex abutment and for movement of said operating end between first and second positions on opposite sides of a neutral plane passing through said effective pivot point and said convex abutment, means including fastening means providing a first resilient force in a first path relatively between said operating end and said base with said lever in said first position and with said first force resisted by said abutment, means including said fastening means providing a second resilient force in a second path relatively between said operating end and said base with said lever in said first position and with said first and second forces being disposed at an inclusive angle in the order of 20° to 160°, means providing a frictional force between said operating end and said abutment at least in said first position of said lever to resist said first force and establish static equilibrium despite the said first and second forces being at other than 180°, and first and second mutually cooperable contact means connected to be actuated between open and closed circuit conditions in accordance with movement of said lever between said first and second positions.

Other objects and a fuller understanding of the invention may be had by referring to the following description and claims, taken in conjunction with the accompanying drawing.

DESCRIPTION OF THE PREFERRED EMBODIMENTS

Figure 1:
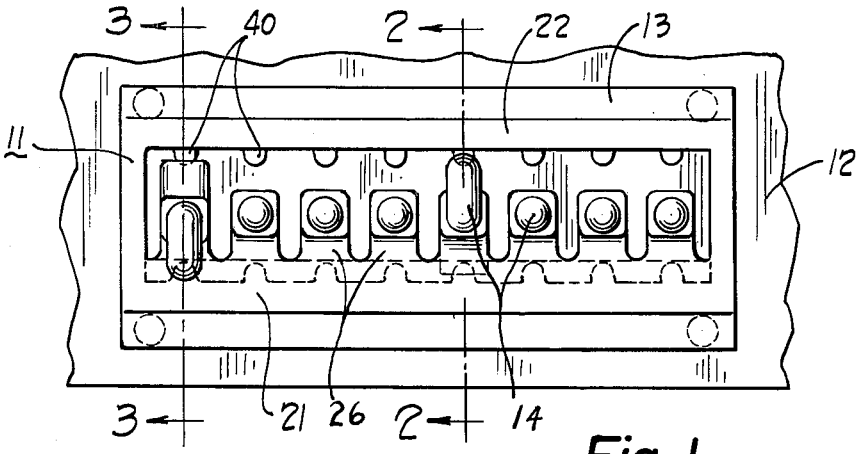
FIG. 1 is a plan view of a switch mechanism embodying the invention.
Figure 2:
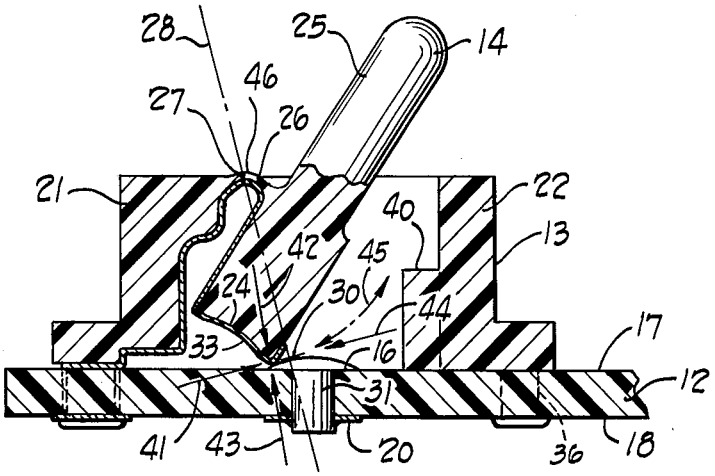
FIG. 2 is a sectional view on line 2-2 showing a closed circuit condition.
Figure 3:
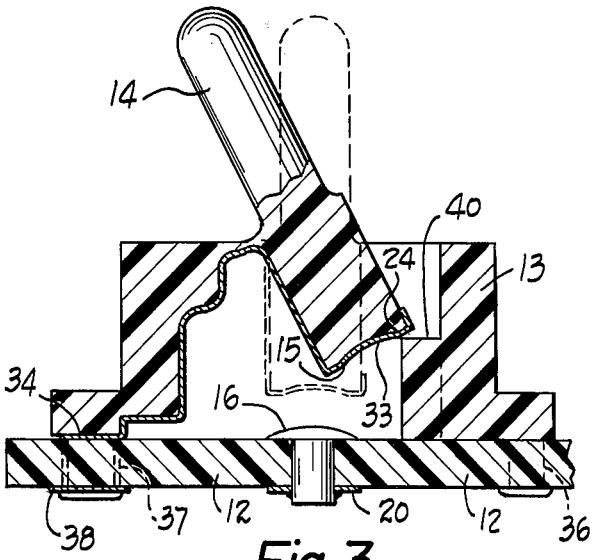
FIG. 3 is a sectional view on line 3-3 showing an open circuit condition.

FIGS. 1, 2 and 3 shown one of the preferred embodiments of the invention of a switch mechanism 11 which includes generally a base 12, a housing 13, lever means 14, and first and second contact means 15 and 16, respectively. The switch mechanism may be simply constructed as either a single pole or a multiple pole switch and a multiple pole switch is illustrated in the drawing. The switch mechanism 11 may be used with the base 12 which has first and second sides 17 and 18. This base 12 may be of insulating material and may have a conductor pattern 20 on the second side 18 thereof. This conductor pattern may be of any suitable forms for example a printed circuit. The housing 13 may be of insulating material, for example a semi-rigid plastic, e.g. nylon, which has a front wall 21 and a rear wall 22. The lever means 14 may be a single lever or when the switch mechanism 11 is constructed as a multiple pole switch as shown in FIG. 1, there are a plurality of such levers 14 one for each number of poles and one each in a predetermined position along the housing 13. In the particular embodiment shown in FIG. 1, there are nine poles to this switch mechanism but this is merely by way of example. The levers are all identical and only one such lever will be described in detail as is shown in FIGS. 2 and 3. Each lever 14 has an operating end 24 and a handle 25. The lever 14 is fastened relative to the base 12 or housing 13 and in the embodiment shown in FIGS. 1, 2 and 3 is fastened to the housing 13. This fastening is about a pivot point to permit pivotal movement of the handle 14. In the embodiments of FIGS. 1, 2 and 3 this fastening of the lever to the housing 13 is by way of a unitary hinge 26 so that the handle 14 may move about an effective pivot point 27. This point 27 is called an effective pivot point because it will be appreciated that there is no physical hinge pin. This unitary hinge 26 may be made of a shape which is thin as viewed in FIG. 2 yet fairly wide as viewed in FIG. 1. The unitary plastic hinge may be thin in the order of 0.004 inches to 0.015 inches in thickness as viewed in FIG. 2. Because the unitary hinge 26 is stressed primarily as a cantilever beam, the effective hinge point is approximately one-third of the distance from the mounting point on the front wall 21 to the lever 14. A neutral plane 28 passed through this effective pivot point 27.

The switch mechanism 11 also includes an abutment 30 which in this embodiment is a convex abutment and for simplicity and ease of construction of the switch mechanism may be the head of a rivet 31 passing through an aperture in the base 12 and electrically connected to a part of the conductor pattern 20. This abutment 30 in the embodiments of FIGS. 1, 2 and 3 is a contact of the second contact means 16 as shown in FIG. 2 there are individual contacts 30 for each of the multiple poles of the switch mechanism 11, one contact in each of the predetermined positions. The switch may be of the miniature type, with spacing of the contacts 16 being in the order of 0.100 inches or 0.200 inches.

The first contact means 15 includes an electrically conducting surface 33 on the lever 14. The lever 14 may be entirely of conducting material or as better shown in FIGS. 2 and 3 may have only a conducting material on the surface thereof. This may be formed by plating, for example, and may be a coating on the entire lever 14 and housing 13 or as shown may be only on selected areas of the lever 14 and housing 13. Such conductive surface may be quite thin in the order of 0.001 inches or even as thin as 0.0001 inches but is shown in FIGS. 2 and 3 greatly enlarged in thickness in order to illustrate it in the drawings. Where the switch mechanism 11 is a multiple pole switch as shown in FIG. 1, then the first contact means 15 includes a common conductor 34 having a plurality of individual contact portions 33 which in this case lie on the operating end 24 of the lever 14. The housing 13 may include integral plastic mounting studs 36 which pass through mounting apertures in the base 12. At least one of these mounting studs includes a part of the conducting surface 37 for connection to a conductor 38 which is a part of the conductor pattern 20 on the second side 18 of the base 12. The conductor 38 may be designated a common conductor which may be ground, for example, or may be some other reference voltage, e.g. 5 volts. This provides a common reference potential for all of the contacts 33 of the first contact means 15.

The housing rear wall 22 includes a latch shoulder 40 to cooperate with the operating end 24 of lever 14 as shown in FIG. 3.

OPERATION

The switch mechanism 11 may be simply constructed of a minimum of parts. The housing 13 and all of levers 14 may be constructed as one unitary part in a most simple mold, namely, only a two-part mold. The levers 14 would be molded in the upright position shown in dotted lines in FIG. 3 so that a straight pull apart of the mold halves may be achieved. This molding would create the unitary flexible hinges 26 which fasten and support the levers 14 for movement. Plating of plastic materials has been perfected with only a very thin coating of metal being applied on the plastic parts. With the hinge 26 being thin in the order of 0.004 to 0.015 inches in thickness, the limited flexing of the handle 14 will minimize tendency of the plated metal to flake off such hinge. Additionally, the housing walls 21 and 22 may be shaped to be close to the operating end 24 of the lever in each of its two positions to limit the flexing of the lever. The first position of the lever is shown in FIG. 2 and the second position is shown in FIG. 3. The two different positions of the lever 14 provide a change between open circuit and closed circuit conditions of the pole of the switch mechanism 11. As shown in this embodiment of FIGS. 1, 2 and 3 the first position of the lever operating in 24 results in a closed circuit condition with the contact portion 33 in engagement with the rivet head or convex abutment 30 of the second contact means 16. The second position of the lever 14 is as shown in FIG. 3 and results in an open circuit condition of the switch. Alternatively, the lever 14 may be left in the dotted line position of FIG. 3 for an open circuit condition, however, if vibration, movement or inertia is a problem, then the operating end 24 of the lever 14 may be latched over the latch shoulder 40 as shown in FIG. 3 to positively establish this open circuit condition.

The neutral plane 28 passes through the effective pivot point 27 and also through the high point of the convex abutment 30. Accordingly, the first position of the operating end 24 of the lever 14 is on a first side of this neutral plane 28 and the second position of this operating end 24 is on the opposite side of the neutral plane 28. The means to fasten the lever 14 relative to the housing 13, provides in the case of FIGS. 1, 2 and 3, a first resilient force 41 along a first path 45 which is the path of movement of the operating end 24 of the lever 14. Second, third, and fourth forces 42, 43 and 44, respectively, also act on the operating end 24 of lever 14. The first force 41 is a resilient force caused by the flexing of hinge 26 as a cantilever beam. In the first position, the lever 14 has been deflected out of its position as molded, as shown in the dotted line position of FIG. 3. Accordingly, the lever tends to return to its original position thus establishing a first resilient force 41. The person manipulating the handle 25 to move the lever to the first position shown in FIG. 2 must cause the lever to swing clockwise past the high point of the convex abutment 30. This bulges the unitary hinge 26 upwardly at 46 as shown in FIG. 2 and this creates the second force 42 which is a resilient force urging the contact portion 33 of the first contact means 15 toward the second contact means 16. The third force 43 is illustrated in FIG. 2 as being generally equal and opposite to the second force 42 and in this embodiment is not really a resilient force except for the minor deflections of the base 12 and walls of the housing 13. The fourth force 44 is a frictional force between the contact portion 33 and the convex abutment 30 to help establish static equilibrium of the lever 14 as shown in FIG. 2.

The first and second forces 41 and 42 are generally perpendicular to each other, as shown in FIGS. 2 and 3, in this embodiment and preferably in the order of 80° to 100° relative to each other but may be as much as 20° to 160° to each other.

In order to move the switch lever 14 from the first position of FIG. 2 to the second position of FIG. 3, a force must be applied which aides generally the first resilient force 41. The initial movement of the operating end 24 of lever 14 will be along a tangent to the convex abutment 30 at the point of engagement. This is a slighly more elevated direction than the first path 45 which the lever operating end desires to take. Accordingly, the operating end 24 must move upwardly, as viewed in FIG. 2, thus further stressing the hinge 26 and creating an even larger deflected bulge 46 which increases the second resilient force 42. Accordingly, the operator must overcome this increased force 42 as well as the frictional force 44 in order to move the lever operating end 24 past the neutral plane 28. Once this point is passed the lever will move easily to an open circuit condition as shown in the dotted or full line position of FIG. 3.

Figure 4:
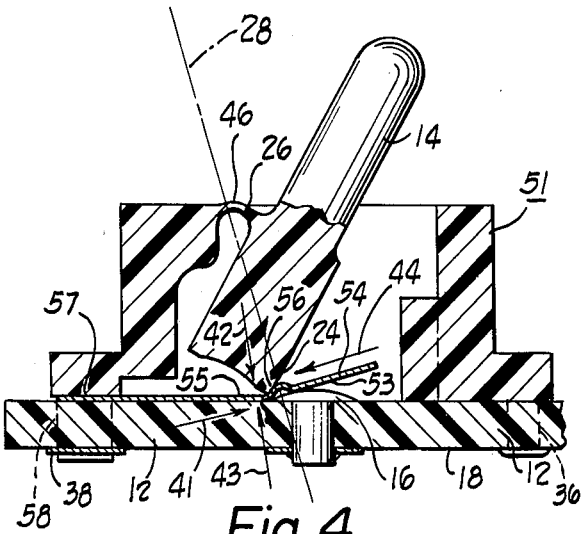
FIG. 4 is a view similar to FIG. 2 showing a modification.

FIG. 4 shows a modified switch mechanism 51 which generally is similar to the switch mechanism 11 of FIGS. 1–3 with similar parts being given similar reference numerals. The differences in the switch mechanism 51 include the addition of a first contact means 55 which includes a contact blade 54 having a contact portion 53 and an actuable portion 56. Where the switch mechanism 51 is constructed as a multiple pole switch, as shown in FIG. 1 for example, then the contact blade 54 is one of several blades transversely connected to a common conductor 57 as much as the teeth of a comb are connected to the rear strip of a comb. This common conductor 57 may have extension tabs 58 passing through apertures in the base 12 to electrically engage the common conductor 38 on the second side 18 of the base 12. The same four forces 41–44 act on the operating end 24 of the lever 14 relative to the second contact means 16. The first resilient force 41 tries to swing the lever counter clockwise as caused by the cantilever bending of the hinge 26. The second force 42 is also a resilient force caused by the bulging upwardly at 46 of the hinge 26. The third force 43 is in this embodiment a resilient force caused by the cantilever mounting of the contact blade 54. The frictional force is again generally in opposition to the first resilient force 41.

Figure 5:
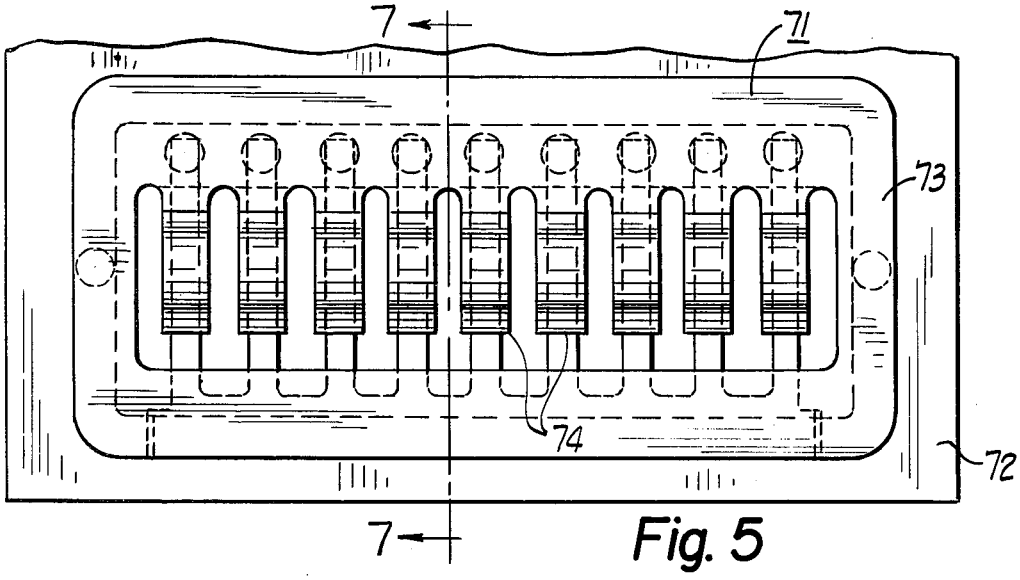
FIG. 5 is a plan view of a further modification of a switch mechanism embodying the invention.
Figure 6:
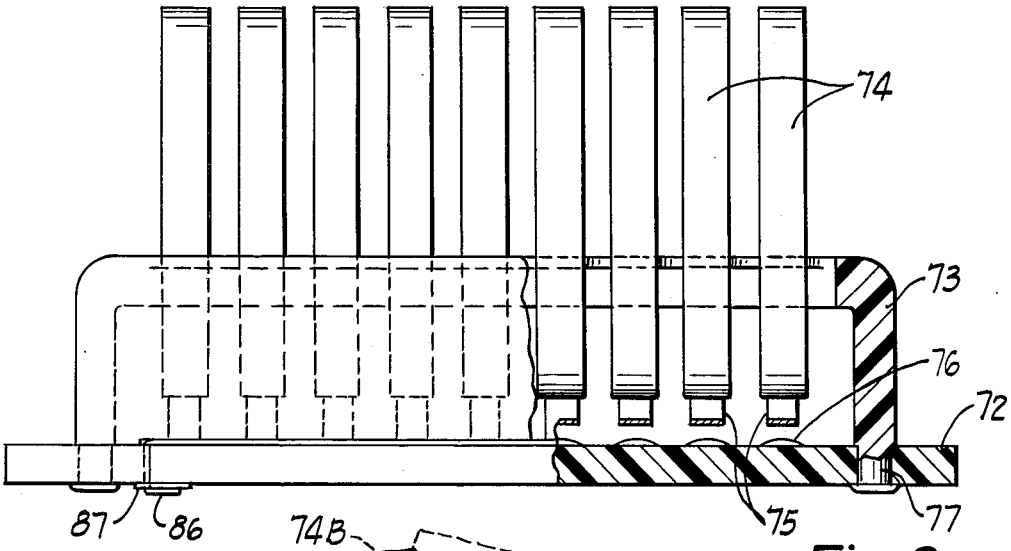
FIG. 6 is a front elevational view partly in section of the switch mechanism of FIG. 5.
Figure 7:
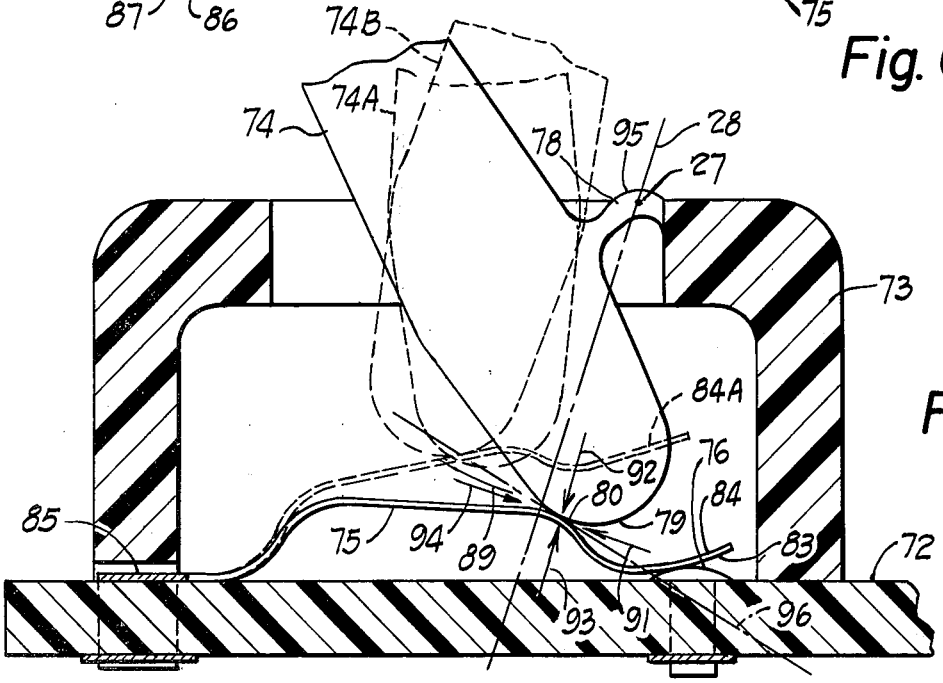
FIG. 7 is an enlarged sectional view on line 7-7 of FIG. 5.

FIGS. 5, 6 and 7 illustrate a third embodiment of the invention and show a switch mechanism 71 which includes generally a base 72, a housing 73, to which are fastened lever means 74 and the space between the base 72 and the housing 73 encloses first and second contact means 75 and 76, respectively. Again the base 72 may be an insulating member and carry a conductor pattern e.g. by means of a printed circuit. The housing 73 may be secured to the base 72 by unitary mounting studs 77 which pass through mounting apertures in the base 72 and are headed by heat deforming. The lever means 74 is fastened to the housing 73 for movement relative thereto and in this one of the preferred embodiments the fastening is by means of the unitary hinge 78. The lever means 74 may be one lever or may be a plurality of levers one each in a plurality of predetermined positions, as shown in FIGS. 5 and 6, in order to achieve a multiple pole switch mechanism. The levers 74 are all identical and each lever has an operating end 79 to coact with a convex abutment 80. This convex abutment 80 is an actuable portion of a contact blade 84 which contact blade also has a contact portion 83 which is a part of the first contact means 75. The contact blade 84 has a mounting portion 85 secured between the housing 73 and base 72.

Where the switch mechanism 71 is a multiple pole switch the mounting portion 85 may be a common portion or rear strip of a comb-like structure with the contact blade 84 similar to the teeth of a comb. The rear strip mounting portion 85 may have extension tabs 86 passing through apertures in the base 72 to engage a common conductor 87 which is a part of the conductor pattern on the base 12, e.g. a part of the printed circuit. Again this may be a common conductor such as ground or a reference voltage for all of the contacts of the first contact means 75. The second contact means 76 again may be individual contacts, for example, similar to those shown in FIGS. 1–4, namely, provided by the heads of rivets extending through the base 12 and in electrical connection with different portions of the conductor pattern.

OPERATION

The switch mechanism 71 may operate in a manner similar to that of the switch mechanisms 11 and 51. A neutral plane 28 is again established and defined by the effective pivot point 27 and the high point of the convex abutment 80 on the contact blade 84. The operating end 79 of the lever 74 is shown in full lines in a first position on one side of the neutral plane 28 and may be moved clockwise along a first path 89 to move past the high point of the convex abutment 80 to a second position on the opposite side of the neutral plane 28. This second position may be shown by position 74A shown in dotted lines or 74B shown in dotted lines in FIG. 7. The position 74A would be the neutral position in which the lever 74 was molded as a part of the semirigid plastic housing 73. The position 74B would be an off circuit condition of the switch as pushed to that position by the resilient mounting of the cantilever contact blade 84.

Again first, second, third and fourth forces act on the operating end 79 of the lever 74 relative to the convex abutment 80. These four forces 91, 92, 93 and 94 are shown by arrows in FIG. 7. The first force 91 is a resilient force caused by the cantilever bending of the hinge 78. The second force 92 is a resilient force caused by the upward bulging at 95 of the hinge 78. The third force is a resilient force caused by the downward stressing of the contact blade 84. The fourth force is a frictional force resisting clockwise movement of the operating end 79 of the lever 74.

The switch mechanism 71 is in static equilibrium with all of the four forces balanced to zero in the first position of this switch. In order that an operator may move the switch from the first position to the second position on the opposite side of the neutral plane 28, a clockwise force must be exerted on the lever 74. The initial movement of the operating end 79 will be along the first path 89 which is generally parallel to a tangent 96 to the convex abutment at the point of the interengagement with the lever 74. However, this movement of the operating end 79 will not follow along the first path 94 in most cases because of the stiffness of the contact blade 84. When the contact blade 84 is in the position 84A shown in phantom in FIG. 7, which is the off position of the switch, this contact blade is stressed only as a cantilever blade. However, when the blade is in the full line position of FIG. 7, the outer end of the contact blade is supported on the second contact means 76. This means that clockwise motion of the lever 74 will be resisted by the contact blade with considerably greater force because the blade at this time will be supported as a beam or as an arch or as a combination of the two, and, thus, will deflect relatively little during this clockwise motion of the lever. Accordingly, the hinge 78 will bulge upwardly at 95 to permit the operating end 79 to move past the high point of the convex abutment 80 to the second position 74B whereat an open circuit of the switch is achieved.

It will thus be observed that the fastening means, namely, the hinge 26 or 78 of each lever is that which establishes a first resilient force in the first path 45 or 89 which tends to swing the lever back to a normal position. This is a tendency to swing the lever operating end from the first position shown in FIGS. 2, 4 and 7 past the neutral plane 28 to a second position whereat a different switch condition is achieved. Also, this same fastening means of the hinge 26 and 78 establishes a second resilient force in a second path which is generally transverse to the first path. These forces may be as much as 20° to 160° from each other and generally are in the order of 80° to 100° relative to each other in order to achieve static equilibrium when the switch lever is in the first position. Further, it will be noted that the first force 41 or 91 is at a small acute angle in the order of 10° relative to a tangent to the convex abutment 30, 56 or 80.

The plurality of levers 14 or 74 are selective actuator means for each of the switch pairs, a switch pair being made of one contact of the first contact means 15, 53 or 75 and a contact of the second contact means 16 or 76. The engagement of the operating end 24 or 79 of the lever with the convex abutment 30, 56 or 80 is a detent to restrain movement of each lever from this first position shown in FIGS. 2, 4 and 7. This abutment may be the contact itself as shown in FIGS. 2 and 7 or may be the actuable portion 56 of a contact blade 54 as shown in FIG. 4. The second force 42 or 92 is a resilient force which is increased by increased deflection at the bulge 46 or 95 as each lever is moved from the first position toward a position overriding the detent means. This means that the person actuating a switch lever must exert a force sufficient to overcome this increased resilient second force.

From the above description it will become apparent that the switch mechanisms 11, 51 and 71 are those which permit the assembly of an economical switch with a minimum of parts and yet a multiple pole switch which is programmable and may be actuated a large number of times. As stated above, the switch housing may be made in a simple two-part mold and the levers conveniently may be molded in the verticle position 74A as shown in FIG. 7, for example. The unitary hinges 26 or 78 permit the levers to be actuated a large number of times, at least 50 times, without breaking and the proximity of the walls 21 and 22 of the housing 13, for example, restrain the total excursion of the lever so that the tendency for an operator to break off a lever is minimized. The multiple pole switches of the present invention are useful in a number of situations, especially where an economical multiple pole switch is desired. One example of such use is in a radio control circuit wherein a programmed code of digits is required and as shown in the figures this would be $2^9$ or 512 possible code combinations. Once this digital code is set, the switch mechanism normally need not be changed during the life of the radio equipment or if it does need to be changed, for example, if one might wish to change the numbers on a combination lock, then the programmable switch may easily be changed to a new switch combination.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A switch mechanism comprising, in combination,
a base,
first and second contact means,
means mounting said contact means on said base insulated from each other and mounted for mutual cooperation,
a convex abutment connected to one of said contact means,
a lever having an operating end,
means fastening said lever to said base about an effective pivot point for movement of said operating end between first and second positions on opposite sides of a neutral plane passing through said effective pivot point and said convex abutment,
said fastening means of said lever establishing cooperation of said operating end with said convex abutment and establishing the first and second contact means actuable between open and closed circuit conditions in accordance with movement of said lever between said first and second positions,
means including said fastening means providing a first resilient force in a first path generally tangential to said convex abutment and between said operating end and said base with said lever in said first position and with said first force resisted by said abutment,
means including said fastening means providing a second resilient force in a second path between said operating end and said base with said lever in said first position and with said first and second forces being disposed at an inclusive angle in the order of 20° to 160°,
and means providing a frictional force between said operating end and said abutment at least in said first position of said lever to resist said first force and establish static equilibrium despite said first and second forces being at other than 180°.

2. A switch mechanism as set forth in claim 1, wherein said first and second forces are disposed at an inclusive angle in the order of 80° to 100°.

3. A switch mechanism as set forth in claim 1, wherein said first force is disposed at an acute angle in the order of 10° relative to a tangent to said convex abutment at the point of engagement with said operating end of said lever.

4. A switch mechanism as set forth in claim 1, including the support of said convex abutment relative to said contact means to which it is connected establishing a third force substantially equal and opposite to said second force to help establish said static equilibrium.

5. A switch mechanism as set forth in claim 1, wherein the operating end of said lever is movable generally in the direction of said first force against said frictional force and against a component of said second force to cause said operating end to pass said convex abutment to said second position and to change the circuit condition of said cooperable contact means.

6. A switch mechanism as set forth in claim 1, wherein said first contact means includes a contact blade having a contact portion and an actuable portion, and said actuable portion including said convex abutment.

7. A switch mechanism as set forth in claim 1, including a housing, means securing together said housing and said base and defining a space therebetween, and said contact means being mounted in said space.

8. A switch mechanism as set forth in claim 7, wherein said fastening means includes a unitary hinge between said lever and said housing, to be deformed in two different directions to establish said first and second resilient forces, respectively.

9. A switch mechanism as set forth in claim 1, wherein said lever has an electrically conductive surface acting as part of said first contact means.

10. A switch mechanism as set forth in claim 9, wherein said abutment has an electrically conductive surface and coacts with said operating end of said lever as said first and second contact means.

11. A switch mechanism as set forth in claim 1, including a common conductor and a plurality of individual contact portions in said first contact means, and said second contact means including a plurality of contacts one each cooperable with one each of said contact portions for a plurality of switch pairs in a multiple pole switch.

12. A switch mechanism as set forth in claim 11, including a plurality of levers, one each of said switch pairs connected to be actuated between said open and closed circuit conditions in accordance with movement of a respective one of said levers.

13. A switch mechanism as set forth in claim 11, including a plurality of contact blades one each having said contact portions of said first contact means, and a plurality of levers one each cooperating with respective ones of said contact blades.

14. A multiple pole switch mechanism comprising, in combination, a base, first and second contact means, said first contact means including a common conductor and a plurality of individual contact portions, said second contact means including a plurality of contacts, means mounting said first and second contact means insulated from each other and for mutual cooperation and in predetermined positions relative to said base to establish a plurality of switch pairs, a plurality of levers, pivot means mounting said levers on said base one in each of said predetermined positions and cooperable with the respective switch pair and each lever movably mounted about an effective pivot point to establish said levers movable to a first position on one side of a neutral plane passing through said pivot point to establish one of said open and closed circuit conditions and to establish said levers movable to a second position on the opposite side of said neutral plane to establish the other of said open and closed circuit conditions, means including said pivot means providing a first resilient force between said lever and said base in a first path generally tangential to the direction of movement of said lever between said first and second positions, detent means to restrain movement of each of said levers from said first position thereof, and said first resilient force being developed at least in said first position with said first force being resisted by the engagement of said lever and one of said contact means as said detent means.

15. A multiple pole switch mechanism as set forth in claim 14, wherein said means establishing said first resilient force acts between each of said levers and one of said contact means.

16. A multiple pole switch mechanism as set forth in claim 14, wherein said detent means includes said pivot means providing a second resilient force between said lever and said base in a second path with said lever in said first position and with said first and second forces being disposed at an inclusive angle in the order of 20° to 160°.

17. A multiple pole switch mechanism as set forth in claim 16, wherein said means including said pivot means provides a second resilient force to each of said levers which force is increased as each lever is moved from said first position toward overriding said detent means.

18. A multiple pole switch mechanism as set forth in claim 17, wherein said means applying said second resilient force includes a resilient hinge connection between each of said levers and said base.

19. A multiple pole switch mechanism as set forth in claim 18, wherein said means applying said second resilient force also establishes deflection of a contact blade as a part of one of said first and second contact means.

20. A multiple pole switch mechanism as set forth in claim 14, wherein said detent means includes a detent abutment cooperating with each of said levers.

21. A multiple pole switch mechanism as set forth in claim 20, wherein each of said levers has an operating end coacting with one of said first and second contact means and said abutment is connected to said one of said contact means.

22. A multiple pole switch mechanism as set forth in claim 21, wherein said abutment is connected to said one of said contact means at the area of coacting between said operating end and said one of said first and second contact means.

23. A multiple pole switch mechanism as set forth in claim 21, wherein each of said abutments is a convex abutment.

24. A programmable multiple pole switch mechanism including, a base, a housing assembly, means to secure said housing assembly on said base, first and second contact means, said first contact means including a common conductor member and a plurality of individual contact portions, said second contact means including a plurality of contacts one each of respective ones of said contact portions of said first contact means, means mounting said first and second contact means to said base insulated from each other to establish said contact portions in predetermined positions and one each of said plurality of contacts of said second contact means respectively in said predetermined positions to establish a plurality of switch pairs, means in said housing assembly and said base in said predetermined positions establishing selectively actuator means and the absence of actuator means, said actuator means including at least one actuator in one of said predetermined positions cooperating with a respective one of said switch pairs to establish one of open and closed circuit conditions thereof, and in another of said predetermined positions the absence of actuator means establishing the other of said open and closed circuit conditions of the respective switch pair, means acting between said actuator means and one of said contact means to establish a resilient force therebetween in one of said open and closed circuit conditions, and detent means to resist said resilient force and acting directly between said actuator means and said one of said contact means to maintain static equilibrium thereof.

25. A multiple pole switch mechanism as set forth in clam 24, wherein said actuator means is a movable member coacting with said detent means to be restrained in movement thereby.

26. A multiple pole switch mechanism as set forth in claim 25, wherein said actuator means is a plurality of movable levers one in each of said predetermined positions.

27. A multiple pole switch mechanism as set forth in claim 26, wherein said detent means includes an abutment coacting with one of said first and second contact means for each of said predetermined positions.

28. A multiple pole switch mechanism as set forth in claim 27, wherein said resilient force causes engagement of said detent means and causes engagement of the contact and contact portions of the respective switch pair to establish a closed circuit condition thereof.

29. A multiple pole switch mechanism as set forth in claim 28, wherein each of said levers is provided with a resilient mounting establishing part of said resilient force.

30. A multiple pole switch mechanism as set forth in claim 29, wherein said resilient mounting includes a flexible hinge support of each of said levers from said housing assembly.

31. A switch mechanism comprising, in combination, a base, a first and second contact means, first means mounting said first contact means to said base, second means mounting said second contact means to said base for cooperation with said first contact means, said first and second mounting means mounting said first and second contact means insulated from each other, said first contact means including at least one contact blade having a contact portion and an actuable portion, said second contact means including one contact in a predetermined position to establish with said blade a switch pair actuable between open and closed circuit conditions, a lever having an operating end, means movably mounting said lever relative to said base about an effective pivot point to establish said operating end of said lever for cooperation with said contact blade and to establish said operating end of said lever movable to a first position on one side of a reference plane passing through said pivot point and said contact blade actuable portion to act on said actuable portion and establish one of said open and closed circuit conditions and to establish said operating end of said lever movable past said actuable portion to a second position on the opposite side of said neutral plane to establish the other end of said open and closed circuit conditions, means acting between said lever and said contact blade actuable portion to establish a resilient force therebetween in said first position of said lever, and detent means acting directly between said lever operating end and said actuable portion to resist said resilient force and maintain said lever in said first position.

32. A switch mechanism as set forth in claim 31, including a plurality of contacts of said second contact means, said second mounting means establishing said contacts of said second contact means in predetermined positions along said base, and a plurality of contact blades in said first contact means one each positioned in each of said predetermined positions to establish a plurality of switch pairs.

33. A switch mechanism as set forth in claim 31, wherein said switch pair is in a closed circuit condition with said lever in said first position.

34. A switch mechanism as set forth in claim 31, including a housing, and means mounting said housing to said base to define a space therebetween enclosing the first and second contact means.

35. A switch mechanism as set forth in claim 34, including a handle on said lever, said handle extending outside said housing and said operating end of said lever extending inside said housing.

36. A switch mechanism as set forth in claim 31, including a convex surface on said actuable portion to cooperate with said operating end of said lever, said neutral plane passing through an intermediate portion of said convex surface, and said operating end of said lever engaging said convex surface in said first position.

37. A switch mechanism as set forth in claim 36, including said operating end of said lever engaging said convex surface in said second position.

38. A switch mechanism as set forth in claim 36, wherein said means to establish said resilient force includes means establishing a resilient mounting of said lever to have said lever operating end urged by said resilient force toward said convex surface in said first position.

39. A switch mechanism as set forth in claim 38, including said contact blade having a second resilient force urging said actuable portion against said operating end of said lever in said first position thereof.

40. A switch mechanism as set forth in claim 39, wherein said resilient forces are disposed in the order of 60° to 120° relative to each other.

41. A switch mechanism as set forth in claim 40, including means establishing a frictional force between the operating end of said lever and said actuable portion of said contact blade to establish static equilibrium with said lever in said first position.

* * * * *